United States Patent [19]

Nakada et al.

[11] Patent Number: 4,837,537

[45] Date of Patent: Jun. 6, 1989

[54] REED SWITCH DEVICE

[75] Inventors: Tsutomu Nakada; Yasuhiro Naka, both of Kanagawa, Japan

[73] Assignee: Nippon Aleph Corporation, Kanagawa, Japan

[21] Appl. No.: 151,595

[22] Filed: Feb. 2, 1988

[30] Foreign Application Priority Data

Feb. 6, 1987 [JP] Japan ..... 62026116

[51] Int. Cl.[4] ..... H01H 9/00

[52] U.S. Cl. ..... 335/153; 335/205

[58] Field of Search ..... 335/151, 153, 205, 206, 335/207

[56] References Cited

U.S. PATENT DOCUMENTS

| | | | |
|---|---|---|---|
| 3,205,323 | 9/1965 | Deshautreaux | 335/153 |
| 3,895,328 | 7/1975 | Kato et al. | 335/207 |
| 3,896,281 | 7/1975 | Feoutistov | 335/207 |

FOREIGN PATENT DOCUMENTS

| | | |
|---|---|---|
| 47-23025 | 7/1972 | Japan . |
| 47-29412 | 9/1972 | Japan . |
| 49-42204 | 11/1974 | Japan . |
| 59-3471 | 1/1984 | Japan . |
| 60-47691 | 10/1985 | Japan . |

*Primary Examiner*—E. A. Goldberg
*Assistant Examiner*—Lincoln Donovan
*Attorney, Agent, or Firm*—Sixbey, Friedman, Leedom & Ferguson

[57] ABSTRACT

A reed switch device comprises a pair of magnets such as bar magnets or ring-shaped magnets which are arranged in inverted polar orientations such that they produce magnetic fields acting in opposite directions, and a reed switch which is movable relative to the pair of magnets such that the longitudinal axis of the reed switch is maintained substantially in parallel with the axes of magnetization of the magnets. The relative position between the reed switch and the magnets is detected through activation of the reed switch between on and off states caused in response to a change in the relative position between the pair of magnets and the reed switch.

7 Claims, 3 Drawing Sheets

REED SWITCH DEVICE

BACKGROUND OF THE INVENTION

1. Field of the Invention

The present invention relates to a reed switch device having a pair of magnets and a reed switch.

2. Description of Related Arts

A conventional reed switch device has a magnet which may be a permanent magnet or a solenoid and a reed switch which is adapted for opening and closing a circuit in accordance with the strength of magnetic field applied thereto. The strength of the magnetic field is changed in accordance with the relative position between the magnet and the reed switch so that the reed switch is opened and closed in accordance with the distance whereby the relative position is detected.

It is often experienced that reed switches as products of the same design exhibit a fluctuation in the operation characteristics, namely, the level of the magnetic field at which the reed switch opens and closes. In addition, each reed switch has such a hysteresis that the strength of the magnetic field at which the reed switch is switched from open state to close state and the strength of the magnetic field at which the same is switched from close state to open state differ from each other.

In actually setting a reed switch device, therefore, it is necessary to adjust the strength of the magnetic field by an amount necessary to compensate for the above-mentioned fluctuation in the operation characteristics and the hysteresis. In other words, it is necessary that the relative position between the magnet and the reed-switch is adjusted to effect the above-mentioned adjustment of the strength of the magnetic field. It is also to be understood that the precision of detection of the relative position varies in accordance with the amount of variation of the relative position corresponding to the hysteresis. The amount of variation in the relative position necessary for the compensation for the fluctuation and hysteresis depends on the rate of change in the magnetic field strength in the direction of variation in the relative position. More specifically, the greater the rate of change in the magnetic field, the smaller the variation in the relative position.

Unfortunately, in known reed switch devices, the rate of change in the strength of the magnetic field in the direction of variation in the relative position is rather small, so that the relative position has to be varied largely in order to compensate for the fluctuation in the operation characteristics and for the hysteresis of operation. This makes it difficult to reduce the size of the reed switch device to a satisfactorily level and to impede improvement in the precision of detection.

SUMMARY OF THE INVENTION

Accordingly, an object of the present invention is to provide an improved reed switch device which overcomes the above-described problems of known reed switch devices.

To this end, according to the present invention, there is provided a reed switch device comprising: a pair of magnets which are arranged in inverted polar orientations; and a reed switch which is movable relative to the pair of magnets such that the longitudinal axis of the reed switch is maintained substantially in parallel with the axes of magnetization of the magnets; whereby the relative position between the reed switch and the magnets is detected through activation of the reed switch between on and off states caused in response to a change in the relative position between the pair of magnets and the reed switch.

According to the arrangement of the invention, the strength of the magnetic field produced by the pair of magnets in response to a variation in the relative position changes at a rate which is greater than the rates of change in the strengths of the magnetic fields produced by independent magnets. In consequence, the amount of variation in the relative position which is necessary for activating the reed switch between on and off states can be reduced advantageously.

The above and other objects, features and advantages of the present invention will become clear from the following description of the preferred embodiments when the same is read in conjunction with the accompanying drawings.

DESCRIPTION OF THE PREFERRED EMBODIMENTS

Figure 1:
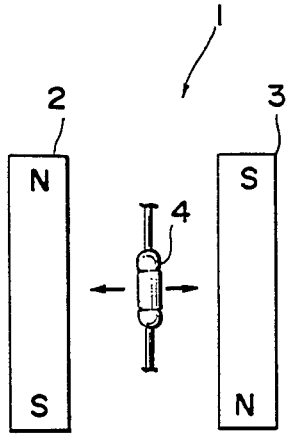
FIG. 1 is a schematic plan view of a first embodiment of the reed switch device in accordance with the present invention.

FIG. 1 is a schematic plan view of a first embodiment of the reed switch device of the present invention. As will be seen from this Figure, the reed switch device of the invention, denoted generally by a numeral 1, has a pair of magnets 2, 3 such as bar magnets, and a reed switch 4 having a magnetic member which is operative in response to a change in the strength of the magnetic field so as to turn the reed switch 4 on and off.

These magnets 2 and 3 are arranged so as to oppose each other leaving a predetermined gap therebetween such that the polarities of these magnets are inverted from each other, i.e., such that an N pole of one 2 of the magnets is positioned besides an S pole of the other 3 of the magnets. The reed switch 4 is so mounted that it can move along a line which interconnects the centers of both magnets 2 and 3 while being maintained substantially parallel to the axes of magnetization of the magnets 2 and 3. That is, the position of the reed switch 4 relative to each of the pair of magnets 2 and 3 is varied in the direction substantially perpendicular to the axes of the magnets 2 and 3.

Figure 2:
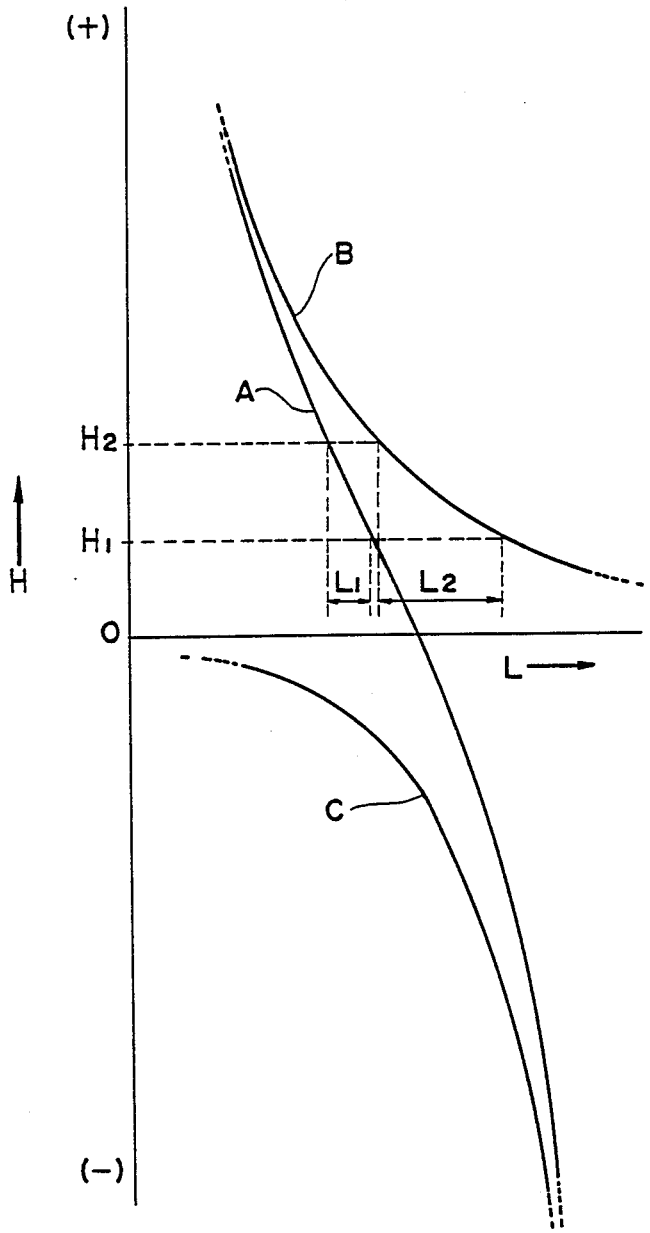
FIG. 2 is a diagram illustrating the manner in which the strength of the magnetic field applied to the reed switch is changed in relation to a change in the position of the reed switch in the reed switch device shown in FIG. 1.

FIG. 2 is a diagram showing the manner in which the strength of the magnetic field applied to the reed switch 4 in the reed switch device 1 is changed in relation to the movement of the reed switch 4. In this figure, the axis of abscissa represents the distance L of the reed switch 4 from the right end surface of the magnet 2 as viewed in FIG. 1, while the axis of ordinate represents the strength H of the magnetic field applied to the reed switch 4. The positive and negative signs imparted to the strength of the magnetic field is determined such that the direction of the magnetic field produced by the magnet 2 is the positive direction. In FIG. 1, a curve A shows the change in the strength of the composite magnetic field formed by both the magnets 2 and 3, while the curve B shows the change in the strength of the magnetic field produced solely by the magnet 2. A curve C represents the change in the magnetic field produced by the magnet 3 solely.

It will be understood from FIG. 2 that the rate of change in the strength H of the composite magnetic field represented by the curve A is greater than the rates of change in the strengths of the magnetic fields produced by the magnets 2 and 3 independently, for a given amount of change in the distance L. This characteristic is obtainable within a region which is limited by the positions of the reed switch 4 where the absolute values of the strengths of the magnetic fields produced by the independent magnets 2 and 3 are produced are maximized. In the illustrated embodiment, this characteristic is obtainable over the entire distance over which the reed switch 4 can travel, i.e., the entire length of the line interconnecting the centers of the magnets 2 and 3 which constitutes the path of movement of the reed switch 4.

It is assumed here that the reed switch 4 has a fluctuation or hysteresis corresponding to an amount of difference of the magnetic field strength expressed by the height difference between the strength levels $H_1$ and $H_2$ as viewed in FIG. 2. In the reed switch device of the invention which operates in response to the composite magnetic field A, the amount of variation in the position of the reed switch 4 corresponding to the height difference between the levels $H_1$ and $H_2$ is represented by $L_1$, which is much smaller than the amount $L_2$ of variation in the position of the reed switch 4 as obtained when the reed switch 4 operates in response to the change in the strength of the magnetic field produced by the magnet 2 solely.

Thus, according to the invention in which the reed switch response to the composite magnetic field formed by a pair of magnets disposed in reversed polarities, the fluctuation or hysteresis of the reed switch 4 corresponds to an amount of variation in the position of the reed switch 4 relative to the magnets 2 and 3 which is very small as compared with the amount of variation in the relative position caused in the known reed switch devices.

This means that, in the reed switch device of the present invention, the amount of change in the relative position necessary for activating the reed switch 4 is very small so that the stroke of the reed switch 4 or of the magnets 2,3 is much reduced as compared with known reed switch devices. Obviously, this makes it possible to reduce the size of the reed switch device and to increase the precision of detection of the relative position. In the described embodiment, the detection of relative position is possible over the entire length of the line interconnecting the centers of the magnets 2 and 3.

A second embodiment of the reed switch device of the present invention will be described with reference to FIG. 3.

This embodiment of the reed switch device, generally denoted by 1, has a pair of bar-shaped magnets 2 and 3 which are disposed in contact with and in a side-by-side fashion with such an inverted polar arrangement that an N pole of one 2 of the magnets is positioned adjacent to an S pole of the other magnet 3. The reed switch device 1 also has a reed switch 4 which is positioned above the plane of the surfaces of the magnets 2 and 3 and movable in the direction perpendicular to the axes of magnetization of the magnets 2 and 3, while keeping its longitudinal axis in parallel with these axes of magnetization. Thus, the relative position between the pair of magnets 2,3 and the reed switch 4 is variable in the direction substantially perpendicular to the axes of magnetization of the magnets 2 and 3.

Figure 3:
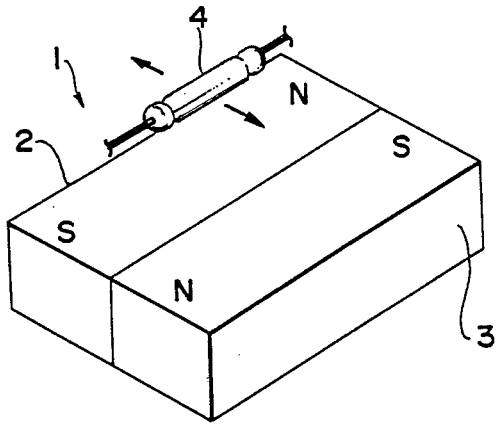
FIG. 3 is a schematic perspective view of a second embodiment of the reed switch device of the present invention.
Figure 4:
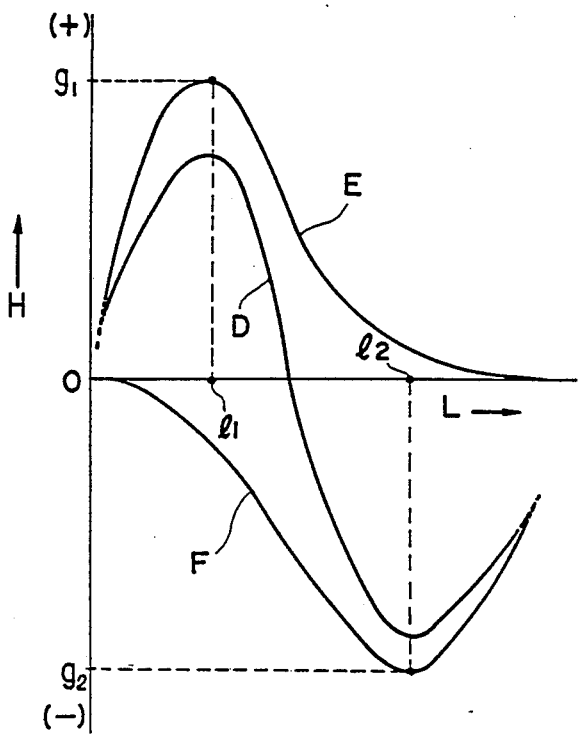
FIG. 4 is a diagram illustrating the manner in which the strength of the magnetic field applied to the reed switch is changed in relation to a change in the position of the reed switch in the reed switch device shown in FIG. 3.

FIG. 4 is a diagram showing the manner of change in the strengths of the magnetic fields produced by the pair of magnets 2 and 3 independently shown by curves E and F, respectively, and that of the strength of the composite magnetic field formed by both magnets 2,3 shown by a curve D. In this figure, the axis of abscissa represents the distance L from the left end surface of the magnet 2 as viewed in FIG. 3, while the axis of ordinate represents the strengths H of magnetic fields, with the strength of the magnetic field produced by the magnet 2 shown in the positive direction.

As will be seen from FIG. 4, the composite magnetic field as represented by the curve D, produced by both magnets 2 and 3, exhibits a greater rate of change than the magnetic fields E and F produced by the independent magnets 2 and 3, in response to a given amount of change in the distance L. More precisely, this tendency is obtained within the region of travel of the reed switch 4 between a point $l_1$ at which the magnetic field E produced by the magnet 2 exhibits a maximum value $g_1$ and a point $l_2$ at which the magnetic field F produced by the magnet 3 exhibits a maximum value $g_2$.

Thus, the second embodiment shown in FIG. 3 produces the same advantages as those derived from the first embodiment, provided that the reed switch 4 is moved along the predetermined path between the positions where the magnetic fields produced by the independent magnets 2 and 3 exhibit the maximum values. Thus, the relative position between the magnets 2,3 and the reed switch 4 can be determined accurately, when the relative position is changed within the above-described region between the positions where strengths of the magnetic fields produced by the independent magnets 2 and 3 are maximized.

Figure 5:
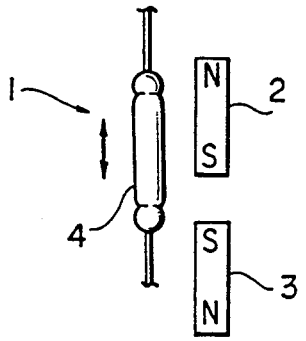
FIG. 5 is a schematic plan view of a third embodiment of the reed switch device of the present invention.

FIG. 5 schematically shows a third embodiment of the reed switch device 1 of the present invention. This embodiment of the reed switch device 1 has a pair of bar-shaped magnets 2 and 3 which are linearly arranged such that their axes of magnetization are linearly aligned and that the poles of the same polarity, e.g., S poles, of both magnets confront each other. The reed switch 4 in this embodiment is arranged to be movable in the region near the side surfaces of the pair of magnets 2, 3 in the directions substantially parallel to the axes of magnetization of the magnets 2,3 while keeping its axis substantially in parallel to the axes of magnetization.

In this embodiment also, the composite magnetic field produced by both magnets 2, 3 exhibits a greater rate of change for a given amount of change in the relative position than the magnetic fields produced by the independent magnets 2 and 3, within the region of the path of relative movement between the points at which the magnetic fields produced by the independent magnets are maximized. Thus, the third embodiment shown in FIG. 5 produces the same advantages as those of the preceding embodiments, provided that the relative position between the magnets 2,3 and the reed switch 4 is changed within the above-mentioned region.

Figure 6:
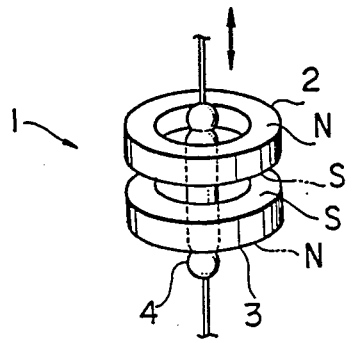
FIG. 6 is a schematic perspective view of a fourth embodiment of the reed switch of the present invention.

FIG. 6 is a schematic perspective view of a fourth embodiment of the reed switch device in accordance with the present invention. This embodiment employs a pair of ring-shaped magnets 2 and 3 which are arranged substantially coaxially with each other leaving a predetermined gap therebetween, such that the poles of the same polarity, e.g., S poles, of both magnets face each other. The reed switch 4 is adapted to be moved along the common axis of the ring-shaped magnets 2 and 3 in directions substantially parallel to the axes of magnetization of these magnets, while keeping its longitudinal axis substantially in parallel to the axes of magnetization of these magnets 2 and 3.

It will be understood that this embodiment produces the same advantages as those produced by the preceding embodiments when the relative position between the magnets 2,3 and the reed switch 4 is changed within the region of path of the relative movement between the positions where the strengths of the magnetic fields produced by the independent magnets are maximized.

As will be fully understood from the foregoing description, the present invention makes it possible to reduce the amount of relative movement between the reed switch and the source of the magnetic field necessary for activating the reed switch and, therefore, to reduce the size of the reed switch device 4 as a whole while enhancing the precision of detection.

Though the invention has been described through its specific terms, it is to be understood that the described embodiment is only illustrative and various changes and modifications may be imparted thereto without departing from the scope of the invention which is limited solely by the appended claims.

What is claimed is:

1. A reed switch device comprising:

a pair of magnets arranged in inverted polar orientations and maintained in a predetermined positional relationship with each other, said pair of magnets providing a region where a strength of a composite magnetic field presented by said pair of magnets changes at a greater rate than a strength of a magnetic field presented by each of said magnets changes, and a reed switch having a longitudinal axis maintained substantially in parallel to axes of magnetization of said magnets, said reed switch being movable relative to said pair of magnets for detection of relative position between said reed switch and said pair of magnets by on-off activation of said reed switch within said region.

2. A reed switch device according to claim 1, wherein said pair of magnets are arranged in parallel with each other leaving a predetermined gap therebetween, and wherein said reed switch is movable relative to said magnets along a line which interconnects the centers of said magnets in the direction of perpendicular to the direction of said axes of magnetization of said magnets.

3. A reed switch device according to claim 1, wherein said magnets are arranged in a side-by-side fashion substantially in contact with each other, and wherein said reed switch is movable relative to said magnets and a path which extends in the vicinity of the surfaces of said magnets and which is substantially perpendicular to said axes of magnetization of said magnets.

4. A reed switch device according to claim 1, wherein said pair of magnets are arranged in series to each other, and wherein said reed switch is movable along a path which is substantially parallel to said axes of magnetization of said magnets.

5. A reed switch device according to claim 1, wherein said pair of magnets are ring-shaped magnets which are disposed coaxially with each other, and wherein said reed switch is movable along the common axis of said ring-shaped magnets.

6. A reed switch device as set forth in claim 1, wherein said region is defined between one point where the strength of magnetic field of one of said magnets is maximum and the other point where the strength of magnetic field of the other of said magnets is maximum.

7. A method for detecting the relative position between a reed switch and a magnetic source, wherein said magnetic source includes a pair of magnets arranged in inverted polar orientations and maintained in a predetermined positional relationship with each other, and said reed switch having a longitudinal axis maintained substantially in parallel to axes of magnetization of said magnets, comprising the steps of:

presenting a composite magnetic field by said magnets within a region, wherein the strength of the composite magnetic changes at a greater rate than or strength of a magnetic field presented by each of said magnets changes;

moving said reed switch with said region thus varying the relative position between said reed switch and said magnets; and activating said reed switch to an on or off state in response to the change in relative position between said magnets and said reel switch in accordance with said composite magnetic field.

* * * * *